US007566209B2

(12) United States Patent
Estes et al.

(10) Patent No.: US 7,566,209 B2
(45) Date of Patent: Jul. 28, 2009

(54) PERISTALTIC PUMP WITH FIELD GENERATOR

(75) Inventors: Judson B. Estes, Milford, MI (US); Scott Van Brocklin, Clarkston, MI (US); Brian Komarisky, Livonia, MI (US)

(73) Assignee: Chrysler LLC, Auburn Hills, MI (US)

( * ) Notice: Subject to any disclaimer, the term of this patent is extended or adjusted under 35 U.S.C. 154(b) by 352 days.

(21) Appl. No.: 11/376,524

(22) Filed: Mar. 15, 2006

(65) Prior Publication Data

US 2007/0217931 A1 Sep. 20, 2007

(51) Int. Cl.
*F04B 43/08* (2006.01)
*F04B 45/06* (2006.01)

(52) U.S. Cl. ..... 417/474; 417/477.12; 417/477.13; 417/479

(58) Field of Classification Search ..... 417/52, 417/322, 474, 477.1, 412, 375, 394, 479; 60/326; 138/122
See application file for complete search history.

(56) References Cited

U.S. PATENT DOCUMENTS

| | | | | |
|---|---|---|---|---|
| 3,677,667 | A * | 7/1972 | Morrison | 417/474 |
| 4,387,670 | A * | 6/1983 | Robin et al. | 123/41.08 |
| 6,318,968 | B1 | 11/2001 | Oliver et al. | |
| 6,872,058 | B2 * | 3/2005 | Doig | 417/477.12 |
| 2005/0275494 | A1 * | 12/2005 | Gharib et al. | 335/220 |

* cited by examiner

*Primary Examiner*—Devon C Kramer
*Assistant Examiner*—Christopher Bobish
(74) *Attorney, Agent, or Firm*—Ralph E. Smith

(57) ABSTRACT

A peristaltic pump assembly for moving a working fluid. The pump assembly includes an expandable fluid that changes in volume due to the presence of a magnetic and/or electric field. The pump assembly also includes a flexible member interposed between the working fluid and the expandable fluid. The pump assembly further includes a field generator operable to cause the expandable fluid to change in volume by applying the magnetic and/or electric field to the expandable fluid. This, in turn, moves the flexible member to increase the pressure of the working fluid to thereby move the working fluid.

13 Claims, 2 Drawing Sheets

PERISTALTIC PUMP WITH FIELD GENERATOR

FIELD OF THE INVENTION

The present invention relates to a pump and, more particularly, relates to a peristaltic pump with a field generator.

BACKGROUND OF THE INVENTION

Many systems rely on pumps to move fluids. However, conventional pumps include motors, gears, and other moving parts that can be relatively loud during operation, which is undesirable. Also, conventional pumps can be susceptible to malfunction because they include many moving parts.

Thus, there remains a need for a pump that operates more quietly. There also remains a need for a pump that is less susceptible to malfunction.

SUMMARY OF THE INVENTION

The present disclosure is related to a peristaltic pump assembly for moving a working fluid. The pump assembly includes an expandable fluid that changes in volume due to the presence of a magnetic field and/or an electric field. The pump assembly also includes a flexible member interposed between the working fluid and the expandable fluid. The pump assembly further includes a field generator operable to cause the expandable fluid to change in volume by applying the magnetic and/or electric field to the expandable fluid. This, in turn, moves the flexible member to increase the pressure of the working fluid to thereby move the working fluid.

In another aspect, the present disclosure relates to a vehicle that includes a first component, a second component, and at least one peristaltic pump assembly interconnecting the first component and the second component. The pump assembly is operable for moving the working fluid between the first component and the second component. The pump assembly includes an expandable fluid that changes in volume due to the presence of a magnetic and/or an electric field. The pump assembly also includes a flexible member interposed between the working fluid and the expandable fluid. Furthermore, the pump assembly includes a field generator operable to cause the expandable fluid to change in volume by applying a magnetic and/or an electric field to the expandable fluid. This, in turn, moves the flexible member to increase the pressure of the working fluid to thereby move the working fluid between the first component and the second component.

In another aspect, the present disclosure relates to a peristaltic pump assembly for moving a working fluid. The pump assembly includes an outer tube and at least one wire coil embedded within the outer tube. The wire coil is operable to generate a magnetic and/or an electric field. The pump assembly also includes a tubular flexible member disposed within the outer tube. The flexible member includes an inner surface that defines a flow channel. The pump assembly also includes an expandable fluid disposed between the outer tube and the tubular flexible member. The expandable fluid is chosen from a group consisting of electro-rheological fluid and magneto-rheological fluid. The expandable fluid is operable to change in volume due to the presence of the magnetic and/or electric field generated by the wire coil. The change in volume of the expandable fluid moves the flexible member and reduces the volume of the flow channel to thereby pressurize the working fluid and move the working fluid in the flow channel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description is merely exemplary in nature and is in no way intended to limit the invention, its application, or uses.

Figure 1:
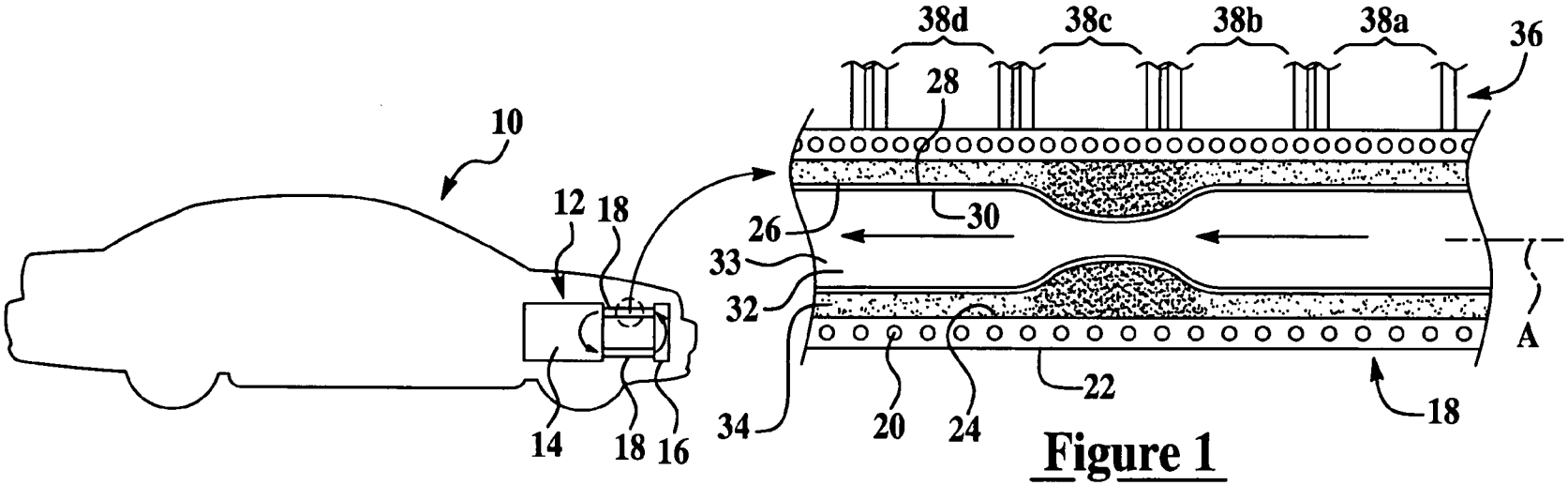
FIG. 1 is a schematic view of a vehicle that includes the peristaltic pump of FIG. 1.

Referring to FIG. 1, one embodiment of a vehicle 10 is shown. The vehicle 10 includes a fluid system 12. The fluid system 12 includes a first component 14, a second component 16, and at least one peristaltic pump assembly 18 interconnecting the first and second components 14, 16. The pump assembly 18 moves a working fluid between the first and second components 14, 16. In the embodiment shown, the fluid system 12 of the vehicle 10 is a cooling system. As such, the first component 14 is an engine and the second component 16 is a radiator in the embodiment shown. The peristaltic pump assembly 18 interconnects the engine 14 and the radiator 16 and allows the working fluid (i.e., coolant) to circulate through the cooling system 12. Those having ordinary skill in the art will appreciate that the peristaltic pump assemblies 18 could be included in any appropriate system 12 associated with the vehicle 10 without departing from the scope of the present disclosure. Those having ordinary skill in the art will also appreciate that the peristaltic pump assembly 18 could be incorporated within any fluid system 12 disassociated with a vehicle 10 without departing from the scope of the present disclosure.

Figure 2:
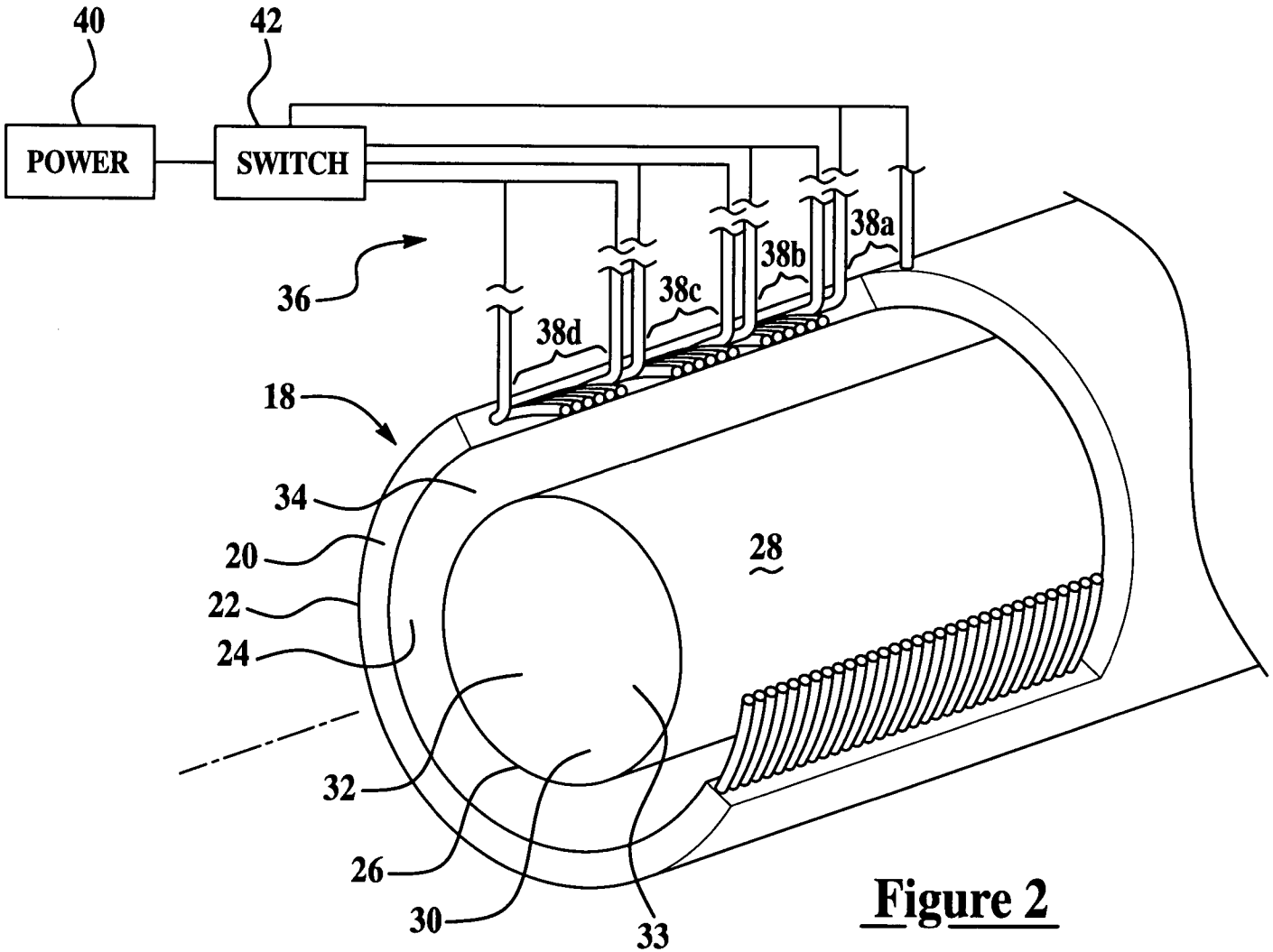
FIG. 2 is a perspective view of the peristaltic pump of the present invention.

As shown in FIGS. 1 and 2, the peristaltic pump assembly 18 includes an outer tube 20. The outer tube 20 includes an outer surface 22 and an inner surface 24. The outer tube 20 is cylindrical and axially flexible. Also, the outer tube 20 is made of a polymeric material. Furthermore, the diameter of the outer tube 20 does not readily change under normal working pressures.

The pump assembly 18 also includes flexible member 26. The flexible member 26 is tubular and includes an outer surface 28 and an inner surface 30. The flexible member 26 is disposed within the outer tube 20. The outer tube 20 defines an axis, A, and the flexible member 26 is coaxial and centered within the outer tube 20. The inner surface 30 defines a working fluid flow channel 32. A working fluid 33, such as engine coolant, flows within the working fluid flow channel 32. Thus, as shown in FIG. 1, engine coolant 33 flows between the engine 14 and the radiator 16 through the flow channel 32.

The flexible member 26 is made out of a flexible material such that the flexible member 26 can contract toward the axis, A, and expand away from the axis, A. The flexible member 26 could be made out of rubber, latex, or a combination thereof.

The contraction and expansion of the flexible member 26 causes movement of the working fluid 33 as will be discussed in greater detail below.

The pump assembly 18 further includes an expandable fluid 34. The expandable fluid 34 is disposed between the outer tube 20 and flexible member 26. As such, the flexible member 26 is disposed between the expandable fluid 34 and the working fluid 33. The expandable fluid 34 is a fluid that changes in volume due to the presence of a magnetic field, an electric field, or a combination thereof. For example, in one embodiment, the expandable fluid 34 is a magneto-rheological fluid. In another embodiment, the expandable fluid 34 is an electro-rheological fluid. Those having ordinary skill in the art will appreciate that the magneto-rheological fluid is a suspension of small magnetizable particles, such as iron particles, in a carrier fluid, such as oil. In the absence of an applied magnetic field, the magneto-rheological fluid can flow readily; however, when a magnetic field is applied, the fluid thickens into a solid or into a semi-solid, pasty consistency, and the volume of the fluid increases as well. Those having ordinary skill in the art will also appreciate that electro-rheological fluids are similar except that the viscosity and volume of the fluid will change in the presence of an electric field.

The pump assembly 18 also includes a field generator 36. The field generator 36 is operable to generate a magnetic field, an electric field, or a combination thereof. The field generator 36 applies the field to the expandable fluid 34 to thereby cause the expandable fluid 34 to change in volume. As will be discussed in greater detail below, the change in volume of the expandable fluid 34 moves the flexible member 26 to thereby reduce the volume of the flow channel 32. This, in turn, increases the pressure of the working fluid 33 and, as a result, the working fluid 33 moves within the flow channel 32.

The field generator 36 includes at least one wire coil 38. The wire coil 38 is embedded within the outer tube 20, and the wire coil 38 is coaxial with the outer tube 20. As the wire coil 38 is energized, the expandable fluid 34 surrounding the wire coil 38 increases in volume to thereby exert pressure against the outer surface 28 of the flexible member 26 as shown in FIG. 1. This causes the flexible member 26 to contract toward the axis, A, and increase the pressure on the working fluid 33 to thereby move the working fluid within the flow channel.

As shown in FIGS. 1 and 2, the field generator 36 includes a plurality of wire coils 38*a*, 38*b*, 38*c*, 38*d*. The wire coils 38*a*, 38*b*, 38*c*, 38*d* are disposed consecutively along the axis, A, of the outer tube 20. The wire coils 38*a*, 38*b*, 38, 38*d* are energized in sequence to thereby move the working fluid 33 substantially in one direction. More specifically, to move the working fluid 33 from right to left in FIG. 1, the wire coil 38*a* is energized, then the wire coil 38*b* is energized, then the wire coil 38*c* is energized, and then the wire coil 38*d* is energized. The field generator 36 includes a power source 40 and a switch mechanism 42 as shown in FIG. 1 to thereby allow the wire coils 38*a*, 38*b*, 38*c*, 38*d* to energize in sequence As such, the peristaltic pump assembly 18 operates substantially with no noise. Also, the pump assembly 18 includes relatively few moving parts, making the pump assembly less likely to malfunction in comparison with conventional pumps.

Figure 3:
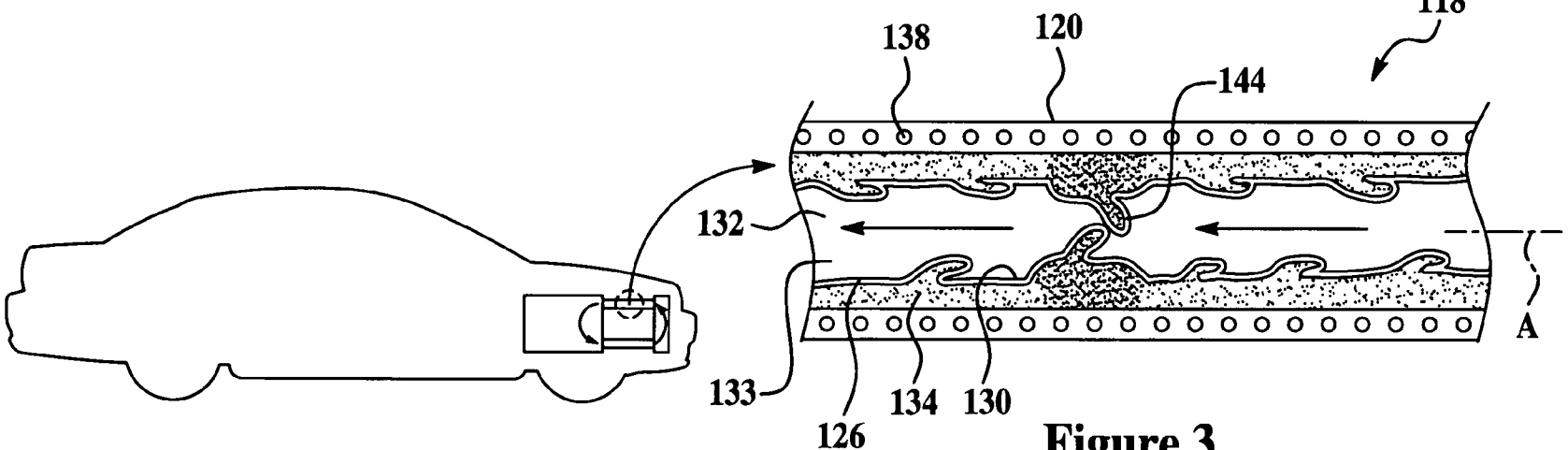
FIG. 3 is a schematic view of a vehicle that includes another embodiment of the peristaltic pump.

Turning now to FIG. 3, another embodiment of the peristaltic pump assembly 118 is illustrated where similar components are indicated with the similar numerals increased by 100 with respect to embodiment shown in FIGS. 1 and 2. The pump assembly 118 includes a wire coil 138 that extends continuously along the axis, A, of the outer tube 20. The wire coil 138 is energized and de-energized in a square wave manner to thereby propagate the magnetic and/or electric field along the axis, A. The propagation of the magnetic and/or electric field moves the working fluid 133 substantially in one direction. Those having ordinary skill in the art will appreciate that the continuous wire coil 138 and the square wave means of energizing the wire coil 138 could be included in the embodiment of the pump assembly 18 shown in FIGS. 1 and 2.

Also, in the embodiment shown in FIG. 3, the flexible-member 126 includes at least one projecting member 144. The projecting member 144 is coupled to the inner surface 130 of the flexible member 126. In one embodiment, the projecting member 144 is helical and extends axially along the inner surface 130 of the flexible member 126. The helical projecting member 144 is formed integrally with the flexible member 126 by an extrusion process in one embodiment. Those having ordinary skill in the art will appreciate that the pump assembly 118 could include a plurality of discrete projecting members 144 without departing from the scope of the present disclosure.

As shown in FIG. 3, the projecting member 144 lies substantially against the inner surface 130 of the flexible member 126 when the wire coil 138 is de-energized. However, when the wire coil 138 is energized, the projecting member 144 moves toward the axis, A, and into the flow channel 132. More specifically, as the electric and/or magnetic field propagates along the axis, A. the expandable fluid 134 affected by the field expands in volume to contract the corresponding section of the flexible member 126 toward the axis, A. The portion of the projecting member 144 that is coupled to the contracting portion of the flexible member 126 pivots into the flow channel 132 to thereby reduce backflow of the working fluid 133 and direct the working fluid 133 in substantially one direction.

In summary, the pump assembly 18, 118 allows for the pumping of a working fluid 33, 133 in a relatively noiseless manner. Also, the pump assembly 18, 118 includes relatively few moving parts such-that the pump assembly 18, 118 is less prone to malfunction.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A peristaltic pump assembly for moving a working fluid comprising:

an outer tube;

at least one wire coil embedded within the outer tube;

an expandable fluid carried by the outer tube that changes in volume due to the presence of at least one of a magnetic field and an electric field; a flexible member comprising a tube disposed inside the outer tube and carrying the working fluid, wherein the flexible member defines a flow channel within which the working fluid can move, and wherein the flexible member include an inner surface and at least one projecting member coupled to the inner surface of the flexible member, the at least one protecting member being helical and extending axially along the inner surface of the flexible member, the at least one projecting member able to move into the flow channel to thereby direct the movement of the working fluid; and a field generator coupled to the at least one wire coil operable to cause the expandable fluid to change in volume by applying at least one of a magnetic field and an electric field to the expandable fluid via the at least one coil, which, in turn, moves the flexible member and the at least one projecting member to increase the pressure of the working fluid to thereby move the working fluid.

2. The peristaltic pump assembly of claim 1, wherein the expandable fluid is chosen from a group consisting of a magneto-rheological fluid and an electro-rheological fluid.

3. The peristaltic pump assembly of claim 1, wherein the field generator is coupled to a plurality of wire coils disposed consecutively along an axis of the outer tube, and wherein the wire coils are energized in sequence to thereby move the working fluid substantially in one direction.

4. The peristaltic pump assembly of claim 1, wherein the at least one wire coil is energized and do-energized to axially propagate the at least one of a magnetic field and the electric field to thereby move the working fluid substantially in one direction.

5. The peristaltic pump assembly of claim 1, wherein the flexible member is made out of a material chosen from a group consisting of rubber, latex, and a combination thereof.

6. A vehicle comprising:

a first component:

a second component; and at least one peristaltic pump assembly interconnecting the first component and the second component, the pump assembly operable for moving a working fluid between the first component and the second component, the at least one pump assembly comprising:

an outer tube;

at least one wire coil embedded within the outer tube;

an expandable fluid carried by the outer tube that changes in volume due to the presence of at least one of a magnetic field and an electric field;

a flexible member comprising a tube disposed inside the outer tube and carrying the working fluid, wherein the flexible member defines a flow channel within which the working fluid can move, and wherein the flexible member includes an inner surface and at least one projecting member coupled to the inner surface of the flexible member, the at least one projecting member being helical and extending axially along the inner surface of the flexible member, the at least one projecting member able to move into the flow channel to thereby direct the movement of the working fluid; and a field generator coupled to the at least one wire coil operable to cause the expandable fluid to change in volume by applying at least one of a magnetic field and an electric field to the expandable fluid via the at least one coil, which, in turn, moves the flexible member and the at least one projecting member to increase the pressure of the working fluid to thereby move the working fluid between the first component and the second component.

7. The vehicle of claim 6, wherein the expandable fluid is chosen from a group consisting of a magneto-rheological fluid and an electro-rheological fluid.

8. The vehicle of claim 6, wherein the field generator is coupled to includes a plurality of wire coils disposed consecutively along an axis of the outer tube, and wherein the wire coils are energized in sequence to thereby move the working fluid substantially in one direction.

9. The vehicle of claim 6, wherein the at least one wire coil is energized and de-energized to axially propagate the at least one of a magnetic field and the electric field to thereby move the working fluid substantially in one direction.

10. The vehicle of claim 6, wherein the flexible member is made out of a material chosen from a group consisting of rubber, latex, and a combination thereof.

11. A peristaltic pump assembly for moving a working fluid comprising:

an outer tube;

at least one wire coil embedded within the outer tube, the at least one wire coil operable to generate at least one of a magnetic field and an electric field;

a tubular flexible member disposed within the outer tube, the flexible member including an inner surface that defines a flow channel within which the working fluid can move, the flexible member further including at least one projecting member coupled to the inner surface of the flexible member, the at least one projecting member being helical and extending axially along the inner surface of the flexible member, the at least one projecting member able to move into the flow channel to thereby direct the movement of the working fluid;

an expandable fluid disposed between the outer tube and the tubular flexible member, wherein the expandable fluid is chosen from a group consisting of an electro-rheological fluid and a magneto-rheological fluid, wherein the expandable fluid is operable to change in volume due to the presence of the at least one of a magnetic field and an electric field generated by the at least one wire coil, wherein the change in volume of the expandable fluid moves the flexible member and the at least one projecting member and reduces the volume of the flow channel to thereby pressurize the working fluid and move the working fluid in the flow channel.

12. The peristaltic pump of claim 11, further comprising a plurality of wire coils disposed consecutively along an axis of the outer tube, and wherein the wire coils are energized in sequence to thereby move the working fluid substantially in one direction through the flow channel.

13. The peristaltic pump of claim 11, wherein the at least one wire coil is energized and de-energized to axially propagate the at least one of a magnetic field arid the electric field to thereby move the working fluid substantially in one direction.

* * * * *